United States Patent [19]

Fisk

[11] 4,033,168

[45] July 5, 1977

[54] STRIP STOCK LIFTER

[76] Inventor: James C. Fisk, G-3219 E. Bristol, Burton, Mich. 48529

[22] Filed: Feb. 17, 1976

[21] Appl. No.: 658,387

[52] U.S. Cl. ..... 72/420; 72/344; 83/373

[51] Int. Cl.[2] ..... B21J 13/08; B21J 13/14

[58] Field of Search ..... 72/344, 345, 346, 405, 72/420; 83/373

[56] References Cited

UNITED STATES PATENTS

| | | | |
|---|---|---|---|
| 2,979,004 | 4/1961 | Kenville et al. | 72/345 |
| 3,247,533 | 4/1966 | Phipard, Jr. | 72/346 X |
| 3,391,439 | 7/1968 | Bulgrin et al. | 72/345 |

*Primary Examiner*—Othell M. Simpson
*Assistant Examiner*—Horace M. Culver
*Attorney, Agent, or Firm*—Burton, Parker & Schramm

[57] ABSTRACT

Relates to devices for separating and supporting strip stock out of engagement with opposing pairs of relatively movable progressive die members and during the separation of the latter and also for guiding the strip stock for intermittent advancement during such periods of separation. More specifically, the invention pertains to the assembly of parts making up such strip stock support and guiding devices and particularly one in which the parts of such a device are all enclosed within a single circular bore in one of the progressive die members including a provision for both releasably coupling the stock lifter member to a support within the bore enclosed to the die shoe and for guiding the lifter member for non-deviating rectilinear motion as the pairs of progressive die members open and close with respect to one another.

21 Claims, 6 Drawing Figures

3
18
52
48
42
10
26
32
38
34
14
22
28
24
30
20
50
46
44
40
36
15
16
12

STRIP STOCK LIFTER

BACKGROUND OF THE INVENTION

In the art of sheet metal pressing, a type of accessory tooling known as the "progressive die" has been and still is extensively used. Many types of work parts require several press operations such as piercing, shearing, forming, drawing, etc. before becoming a finished work piece. Progressive dies comprise a multiplicity of stations, each capable of performing one of said press operations, which are so arranged that they progressively perform these operations without cutting the work part completely free of the strip stock from which it is being made, until the last operation station is reached. The strip stock which is being fed through the die advances a work part one station for each stroke of the press and while the press ram is up. The popularity of the progressive die is due to the fact that a finished part results from each stroke of the press without having to loose-handle the part from one single operation die to another.

Many work parts have offsets and depressions that require these parts to be lifted up out of lower die element, after the die opens, before the strip stock can be advanced to next station, and to achieve this the strip stock is guided through the die by providing a multiplicity of devices engaging both margins of the stock. Each such device is known as a "stock lifter."It usually consists of a relatively small diameter post vertically projecting from a hole in the lower die element and provided both with a spring to drive the liter member upward as the die opens and also with a stop for apportioning its upward movement. Near the upper end of each stock lifter post is a transverse slot for guidably engaging the margin of the strip stock. It will be apparent that the stock lifter must incorporate a feature for restraining it from turning about its own axis in order that its transverse slot will always be properly directed toward the margin of the stock with which it is to be engaged.

Exemplary of conventional stock lifters is that disclosed in the U.S. Pat. to Kenville et al. No. 2,979,004 which employs a key provision outside of the bore containing each stock lifter assembly for limiting upward travel of each spring empowereed lifter and for preventing the stock lifter from rotation about its axis. Conventionally the die steels (working elements of the die) are bolted to a die shoe which serves as an assembly base. The key provision is ordinarily fitted into an individual hole in the die steels while the hole or cavity for spring which functions to raise the stock lifter continues down into die shoe. Such an arrangement has at least three objections. Progressive dies are usually an intricacy of élements crowded into a limited space, and thus any feature which takes up extra room and requires accessibility for assembly and service places an extra burden on the die designer. Moreover, the machine work to make provision for such means is extra labor and cost for the die builder. Some segments of the die steels require periodic top surface grinding, and since integrity of stop surface plane must be maintained these resharpened segments of the die steels must be shimmed up to compensate for stock removed by grinding. This in effect raises the lifter keys, and the stock lifters they serve, mounted in these die steels. Fitting operations on the lifter keys then become necessary to bring the lifter stock slots back down in plane with other lifters in the die.

In view of the above objections, it is apparent that an improved stock lifter is needed in this art and particularly one which is assembled in a single straight hole through the steel and die shoe and takes its vertical location from the die shoe rather thatn die steel, yet is readily removable from top of the lower die member without removing the die from the press. Such an improvement should be advantageous to all major participants in this field of art.

SUMMARY OF THE INVENTION

An important object of the invention is to provide a design of stock lifter devices which simplifies design engineering problems, lessens die manufacturing costs and provides greater convenience to the die user.

Another important object of the invention is to provide in a stock lifter device of the character set forth a novel and improved manner of releasably coupling the lifter member to a supporting member anchored in a die member for precise rectilinear motion.

Another object of the invention is to provide an improved stock lifer assembly for use in the operation of progressive dies and the like which is so designed as to contain all of the parts thereof within a single bore of limited lateral extent.

A further object of the invention is to provide an improved stock lifter device which is capable of being completely assembled before shipment and shipped in such condition for mounting in the die members for which it is intended.

Another important object of the invention is to provide a stock lifter device which is rugged and durable in usage and which is economical to construct, assemble and disassemble, and maintain.

The objects of the invention are effectively and efficiently carried out by a significant construction and cooperation of the parts making up the improved strip stock lifter disclosed herein. The various supporting and operating parts of the stock lifter assembly are contained within a single bore which may extend completely through both the die steel and die shoe of a progressive die assembly. Moreover, these parts are so designed that the stock lifter can be assembled in operating condition in the bore or disassembled for detachment of the lifter body and coupling parts from the bore without disturbing or removing the die steels or die shoes from the press. The coupling parts of the stock lifter are so designed that they may be quickly assembled and disassembled by hand and when assembled will precisely guide the motion of the lifter member so that it does not deviate from its prescribed path of movement.

Various other objects, advantages and meritorious features of the invention will become more fully apparent from the following specification, appended claims and accompanying drawing figures, wherein:

DESCRIPTION OF A PREFERRED EMBODIMENT

Figures 1, 2, 3, 4, 5, 6:
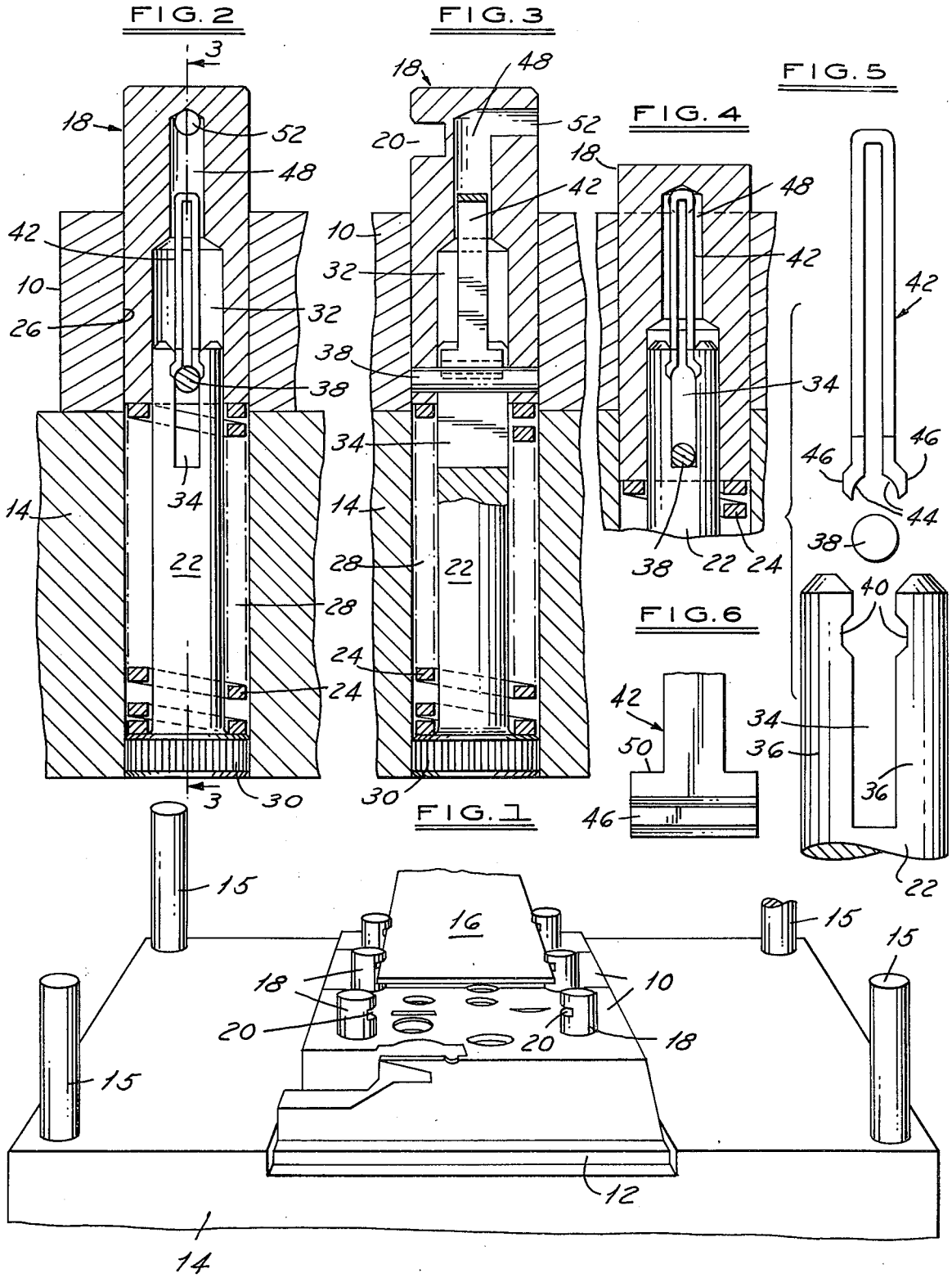
FIG. 1 is a perspective view showing the lower working half of a progressive die assembly and particularly the guiding support of a strip stock material in elevated position by a plurality of stock lifters.
FIG. 2 is an enlarged longitudinal sectional view through one of the stock lifter devices of the present invention.
FIG. 3 is a similar view as FIG. 2 but taken at an angle of 90° thereto.
FIG. 4 is a sectional view similar to FIG. 2 showing the position of the upper parts of the stock lifter device when the latter is fully depressed.
FIG. 5 is a further enlarged exploded view of certain internal parts of the stock lifter device showing the same in the order of assembly.
FIG. 6 is a fragmentary view of one of the parts of FIG. 5 but taken at an angle of 90° thereto.

Referring initially to FIG. 1, a plurality of lower progressive die members 10 are arranged in a row on a spacer plate 12 in some instances and bolted or otherwise secured to a die shoe 14 which in turn is rigidly supported upon a bed of a press (not shown). As illustrated in the aforesaid referenced U.S. Pat. No. 2,979,004, but not shown herein the progressive die assembly also includes a plurality of upper vertically movable die members which cooperate with the lower die members 10 in performing die operations on a strip of sheet metal stock 16 intermittently advanced therebetween. Corner posts 15, however, are shown in FIG. 1 on which the upper die sets are vertically movable. As the strip stock 16 dwells between feeding operations, the upper die members are lowered into compressive engagement with the strip stock and the lower die members with the result all sets of dies perform operations on the strip stock simultaneously. When the upper die members retract from such engagement, the strip stock is advanced so as to bring each worked part of the strip into position for the next die operation thereon. Articles being produced with a variety of such dies remain a part of the strip stock material until they reach the last operation station of the progressive die assembly at which time the articles are separated from each other and the balance of the strip stock material.

This method of die operation requires the raising and lowering of the strip stock 16 between each operation of the dies on the strip stock because of the need to have all depressed portions formed in the strip stock raised above all parts of the lower die members in the path of travel of the stock while feeding advancement of the stock is effected. For this purpose a plurality of stock lifters 18 are located along both sides of the path of travel of the strip stock and shaped to engage the side margins of the strip stock and raise the stock sufficiently high enough to clear the lower die members as well as to provide guides for slidably supporting the strip stock for advancement along its elevated path of travel. The body of each such stock lifter 18 is generally cylindrically shaped and provided near its upper end with a side opening notch or recess 20 of a width slightly greater than the thickness of the strip stop so that the latter may be slidably guided longitudinally therethrough in the manner illustrated in FIG. 1. When each die operation is performed the relative approach of the two upper and lower die members causes the projecting ends of the stock lifters to be depressed below that shown in FIG. 1 against the resistance of springs which will return the lifters to their raised condition in FIG. 1 as soon as the superposing die members are separated from one another.

The improved stock lifter of the herein disclosed invention incorporates a stationary stem or post 22 inwardly coaxial with the lifter compression spring 24 and lifter body 18, the several elements being enclosed within aligned holes or bores 26 and 28 of corresponding cross section extending completely through the die steel 10 and die shoe 14 as evident in FIGS. 2 and 3. The stem has an enlarged circular head 30 at the lower extremity of the hole or bore 28 of the die shoe and is press fitted therewithin or otherwise fixedly secured thereto and determines as will be brought out more fully hereinafter the lifter's maximum upward extended position from the die shoe rather than the die steel as heretofore. The annular shoulder formed by the enlarged head 30 provides a seat for the lifter compression spring to rest on. The lifter spring 24 encircles the stem 22 and reaches upwardly therearound to act against a radially outward portion of the lower face of the stock lifter body 18 and yieldingly urges the lifter to its raised position in the bore 28 of the die steel 10. The stationary stem member 22 continues upwardly beyond the spring to project into an axially aligned hole or bore 32 in lifter body for slidable engagement therewith, and key means is provided in this area of overlapping engagement to limit or stop upward travel of the lifter and also to restrain the lifter from rotating about its own axis.

A preferred embodiment of the invention has a central axially running, upwardly opening slot 34 in the upper section of the stem body 22 where it overlaps the stock lifter. The slot divides the upper section of the stem member into two parallel branches 36—36 of a bifurcated configuration which is evident in the bottom portion of FIG. 5. Through the lower skirting extremity of the lifter body is a cylindrically shaped transversely extending coupling pin 38 slidably workable within the stem slot 34. As shown in FIG. 3, the coupling pin 38 has a length greater than the width of the slot so that the opposite ends of the pin protrude into the body of the stock lifter and may be press fitted or otherwise secured therein, thus providing means internal of the device for restraining rotation of lifter body relative to the stem. Further means yet to be described cooperates with the coupling pin to provide an upper limit stop for the lifter body.

Near the upper end of the stationary stem there is cut or otherwise formed in each of the two confronting faces of the branches 36—36 of its slot 34 a similar small transverse groove 40 having a flat bottom which parallels the axis of the stem and whose sides are bevelled at a cam angle in the order of 45°. These two similar grooves are directly opposite each other as evident in FIG. 5. A forked key 42 of U or hairpin shape and preferably made of a stiff elastic material, such as spring steel, has the inner faces 44 of its open end arcuately flared out on a radius of curvature substantially corresponding to that of the coupling pin 38 to embrace the upper half of the coupling pin in the manner shown in FIGS. 2 and 3. The external faces 46—46 of the open end of the forked key 42 are ribbed or angularly shaped as best shown in FIG. 5 for fully nesting within the transverse grooves 40—40 of the branches 36—36 of the bifurcated section of the stem member 22. In this manner, the distal ends of the bifurcated branches of the stem member will fully receive the flared ends of the hairpin shaped key 42 member when its open end is pushed axially into stem slot 34, the ends of the key camming inwardly allowing the key to slide into stem slot until key bibs snap outwardly into the transverse key grooves in the branches 36—36 forming the slot 34. This is the working position of hairpin shaped key.

When the lifter body 18, after full depression, is forced upwardly by the lifter spring 24, the coupling pin 38 slides up the stem slot until it fits into the flared opened end 44 of forked key. The pin's presence there prevents the forked key 42 from collapsing inwardly as it normally would under axial thrust and thus with the flared end of the forked key nestingly held in the stem grooves, the coupling pin 38 and thus the lifter body 18 is restrained or stopped from further upward progress. Because the forked lifter key projects axially upward from the stem 22, it is necessary to further drill or otherwise provide a blind clearance pocket 48 for it in the lifter body beyond the hole for extreme entry of the stem. This clearance pocket extends near the upper end of lifter body. The length of the forked lifter key 42 is such that when the lifter body 18 is being fully depressed, the key 42 is struck by the end of the clearance pocket. Further depression of the lifter body 18 will force the open end of the forked key into nested working assembly with the grooves in the stem slot thereby in effect automatically coupling the stock lifter 18, the stem 22, and the key 42 into their working relationship.

With further reference to the key 42, it should be noted as shown in FIG. 6 that the opened ribbed end 46—46 of the key has a lateral extent 50 greater than that of the longitudinal side sections of the key's hairpin shape but slightly less than the diameter of the central bore 32 of the lifter body 18 as evident in FIG. 3. This provides a good seating engagement between the coupling pin 38 and the key 42 while at the same time maintaining the desired flexibility in the key for contracting the opened ends 46—46 together when disassembling the parts.

Near the upper extremity of the stock lifter 18 is a small transverse hole 52 running hole 52 running into the key clearance pocket 48 which not only serves as an air vent but also enables a small tool in the shape of a straight pin (not shown) to be manually inserted into the loop of the forked key while the stock lifter is being held in completely depressed position. Now when the stock lifter 18 is permitted to rise the forked key 42 is pulled upward by the inserted pinshaped tool without the coupling pin 38 being between the open flared ends 44—44 of the forked key with the result that these ends of the forked key can be readily disengaged from the angled grooves 40—40 of the stem 22 thereby enabling the removal of lifter body from the die for servicing purpose.

This improved stock lifter involves an absolute minimum of die design effort or machine work to accommodate it; it only requires one reamed hole of one diameter straight through the die steel and die shoe. It requires a minimum of die space and minimum initial assembly effort. All one has to do is to insert the already assembled stock lifter device in the reamed hole with its stock slot 20 properly directed toward the path of travel of the strip stock 16 and then press the stem head 30 into place in the bore 28 of the die shoe. For disassembly, all one has to do is to employ the simple pin-shaped tool, and the lifter body and spring are quickly removable from top of lower die assembly for servicing, such as cleaning, replacement of fatigued spring, or for sharpening of die steels. The stock lifter is instantly reassemblable by hand without tools and no fitting is required to compensate for any needed die regrind. Each stock lifter device is capable of being shipped or otherwise handled completely assembled (no loose screws, spring, keys, etc.). All parts are designed for adequate strength and durable reliability, and the disclosed improved design is capable of being produced at competitive cost.

While a particular embodiment of the invention has been shown and described, it will be understood, of course, that it is not desired that the invention be limited thereto since modifications may be made, and it is therefore contemplated by the appended claims to cover any such modifications as fall within the true spirit and scope of the invention.

What is claimed is:

1. A stock lifter device for use in pairs and at opposite edge portions of strip stock for separating and supporting the strip stock out of engagement with the working face of a die member during performance of die operations upon said stock; said stock lifter device including:

an upright post stationarily mounted so that the upper end portion of the post is projectible into the lower end section of a bore in the die member that extends through the die member and opens out on the working face thereof;

a stock lifter body adapted to slidably fit the bore in the die member for endwise movement therein perpendicular to the working face of the die member, the upper end of the body having a side opening recess for receiving and supporting a marginal edge portion of the strip stock;

a helically coiled spring encircling the post and acting on the lower end portion of the stock lifter body to yieldingly project the upper end of the body outwardly of the working face of the die member; and a pin and slot connection coupling the stock lifter body to the post and enabling the body to move under the influence of said coiled spring or in response to opposing die operating forces overcoming that of the spring, said pin and slot connection being located within the bare and so shaped as to restrain the stock lifter body against rotation about its axis while guided in its reciprocal motion within the die member.

2. A stock lifter device for use in pairs and at opposite edge portions of strip stock for separating and supporting the strip stock out of engagement with the working face of a die member during performace of die operations upon said stock; said stock lifter device including:

an upright post stationarily mounted so that the upper end portion of the post is projectible into the lower end section of a bore in the die member that extends through the die member and opens out on the working face side thereof;

a stock lifter body adapted to slidably fit the bore in the die member for endwise movement therein perpendicular to the working face of the die member, the upper end of the body having a side opening recess for receiving and supporting a marginal edge portion of the strip stock;

a helically coiled spring encircling the post and acting on the lower end portion of the stock lifter body to yieldingly project the upper end of the body outwardly of the working face of the die member; and a pin and slot connection coupling the stock lifter body to the post and enabling the body to move under the influence of said coilded spring or in response to opposing die operating forces overcoming that of the spring, said pin and slot connection being so shaped as to restrain the stock lifter body against rotation about its axis while guided in its reciprocal motion within the die member; said slot having an opened end and a stop element sitting astride the open end to limit the extent of travel of the stock lifter body, and said stop element being removable from said astride condition when the stock lifter body has assumed a given position in its path of travel provided by the slot of the pin and slot connection.

3. A stock lifter device as defined in claim 2 wherein said stop element is removable from said blocking position when the stock lifter body assumes a depressed condition with respect to the working face of the die member within which it is slidably supported.

4. A stock lifter device for use with progressive die operations and more particularly for separating and supporting the strip stock out of engagement with the working face of a progressive die member during performance of die operations upon said stock; said stock lifter device including, in combination:

a die member having a vertical bore therethrough which opens out on the working face of the die member;

an upright post stationarily mounted so that the upper end portion of the post projects into the lower end section of the bore in the die member;

a stock lifter body slidably fitting the bore in the die member for endwise movement therein perpendicularly to the working face of the die member;

a helically coiled spring encircling the post and acting on the lower end portion of the stock lifter body to yieldingly project the upper end of the body outwardly of the working face of the die member and thus separate and support the strip stock out of engagement with the working face of the die member; and a sliding connection within the bore and between the upper end of the stationary post and the movable stock lifter body limiting the travel of the body to a prescribed distance and at the same time restraining the body from rotation about its axis.

5. A stock lifter device as defined in claim 4 wherein said sliding connection comprises a slot in the upper end portion of the post and a pin carried by the stock lifter body and slidably fitting the slot in the post.

6. A stock lifter device for use with progressive die operations and more particularly for separating and supporting the strip stock out of engagement with the working face of a progressive die member during performace of die operations upon said stock; said stock lifter device including, in combination:

a die member having a vertical bore therethrough which opens out on the working face of the die member;

an uprigh post stationarily mounted so that the upper end portion of the post projects into the lower end section of the bore in the die member;

a stock lifter body slidably fitting the bore in the die member for endwise movement therein perpendicularly to the working face of the die member;

a helically coiled spring encircling the post and acting on the lower end portion of the stock lifter body to yieldingly project the upper end of the body outwardly of the working of the die member and thus separate and support the strip stock out of engagement with the working face of the die member; and a sliding connection between the upper end of the stationary post and the movable stock lifter body limiting the travel of the body to a prescribed distance and at the same time restraining the body from rotation about its axis;

said sliding connection comprising a slot in the upper end portion of the post and a pin carried by the stock lifter body and slidably fitting the slot in the post, and a key element yieldingly expandibly engageable with the confronting walls of the slot to form a stop against which the pin abuts at one end of its travel.

7. A stock lifter device as defined in claim 6 wherein the key element exhibits a hairpin configuration having the opened end snap fittingly engaged with the confronting walls of the slot to form the stop.

8. A stock lifter device for use in pairs and at opposite edge portions of strip stock for separating and supporting the strip stock out of engagement with the working face of a die assembly during performance of die operations upon said stock, the said die assembly being composed of a die steel member superimposing a die shoe member with each having a vertically aligned bore of the same cross section;

said stock lifter device including an upright post stationarily anchored at its base in the vertical bore in the die shoe member and rising to a height to enter the lower portion of the aligned bore in the die steel member;

a stock lifter body slidably fitting the bore in the die steel member for endwise movement therein;

a helically coiled spring coaxial with the upright post and so mounted as to act on the lower end of the stock lifter body to yieldingly project the upper end of the body outwardly of the working face of the die assembly; and means providing a slidable fit within the aligned bores and between the upper end of the upright post and the stock lifter body so as to guide the body in a straight line, non-rotative motion as it is influenced by the force of the spring or by opposing die operating forces overcoming that of the spring.

9. A stock lifter device as defined in claim 8 wherein the upright post is of reduced thickness as compared with the cross section of the aligned bores so as to form an annular clearance between the post and the adjacent wall portions of the bores, and wherein the coiled spring occupies the annular clearance in encircling relation to the upright post.

10. A stock lifter device for use in separating and supporting strip stock out of engagement with the working face of a die member during performace of die operations upon said stock; said stock lifter device including:

an upright post stationarily mounted so that the upper end portion of the post is projectible into the lower end section of a bore in the die member that extends through the die member and opens out on the working face side thereof;

a stock lifter body adapted to slidably fit the bore in the die member for endwise reciprocating movement therein perpendicular to the working face of the die member, the upper end of the body having a side opening recess for receiving and supporting a marginal edge portion of the strip stock;

a helically coiled spring encircling the post and acting on the lower end portion of the stock lifter body for yieldingly projecting the upper end of the body outwardly of the working face of the die member;

a pin and slot connection coupling the stock lifter body to the post and enabling the body to move under the influence of said coiled spring or in response to opposing die operating forces overcoming that of the spring, the slot being formed in the upper portion of the upright post and opening out through the upper end thereof, and the pin being carried by the stock lifter body crosswise of the slot thereby to restrain the stock lifter body against rotation about its axis as it is guided in its reciprocal motion within the die member; and a key element yieldingly expandibly engageable with the confronting walls of the slot to form a stop against which the pin abuts at the upper end of its travel.

11. A stock lifter device as defined in claim 10 wherein the key element is sufficiently contractible to enable it to be withdrawn from the slot thereby allowing removal of the pin therefrom.

12. A stock lifter device as defined in claim 11 wherein the key element exhibits a U-shaped configuration and when performing as said stop it has its opened ends snap fittingly engaged with the confronting walls of the slot.

13. A stock lifter device as defined in claim 12 wherein the confronting wall portions of the slot engaged by the key element are indented to receive the opened ends thereof.

14. A stock lifter device for use with progressive die operations and more particularly for separating and supporting the strip stock out of engagement with the working face of a progressive die member during performance of die operations upon said stock; said stock lifter device including, in combination:

a die member having a vertical circular bore therethrough which opens out on the working face of the die member;

an upright post of cylindrical shape stationarily mounted so that the upper end portion of the post projects into the lower end section of the bore in the die member;

a stock lifter body of cylindrical shape slidably fitting the bore in the die member for endwise movement therein perpendicularly to the working face of the die member;

spring means yieldingly acting on the stock lifter body to project the upper end of the body outwardly of the working face of the die member and thus separate and support the strip stock out of engagement with the working face of the die member;

a sliding connection between the upper end of the stationary post and the movable stock lifter body limiting the travel of the body to a prescribed distance and at the same time restraining the body from rotation about its axis, said sliding connection including an upwardly opening slot in the upper end of the stationary post and a member slidable therein which is attached to the stock lifter body and restrains the same from rotation about its axis as it moves endwise in the bore of the die member; and a key element yieldingly expandibly engageable with the confronting walls of the form a stop at the upper end of the slot barring egress of the slidable member therefrom.

15. A stock lifter device as defined in claim 14 wherein said key element is sufficiently contractible to enable it to be withdrawn from the slot thereby allowing removal of the slidable member therefrom.

16. A stock lifter device as defined in claim 15 wherein the key element exhibits a hairpin configuration and when performing as said stop has the opened ends snap fittingly engaged with the confronting walls of the slot.

17. A stock lifter device as defined in claim 16 wherein the confronting wall portions of the slot engaged by the key element are indented to receive the opened ends thereof.

18. A stock lifter device for use in separating and supporting the strip stock out of engagement with the working face of a die assembly during performace of die operations upon said stock, the said die assembly being composed of a die steel member superposing a die shoe member with each having a circular vertically aligned bore of the same diameter;

said stock lifter device including an upright post stationarily anchored at its base in the vetical bore in the die shoe member and rising to a height to enter the lower portion of the aligned bore in the die steel member;

a stock lifter body slidably fitting the bore in the die steel member for endwise movement therein;

a helically coiled spring coaxial with the upright post and mounted wholly within the area circumscribed by the aligned bores so as to act on the lower end of the stock lifter body to yieldingly project the upper end of the body outwardly of the working face of the die assembly thus separate and support the strip stock out of engagement with the working face of the die member;

means wholly within the area circumscribed by the aligned bores providing a slidable fit between the upper end of the upright post and the stock lifter body so as to guide the body in a straight line, non-rotative motion as it is influenced by the force of the spring or by opposing die operating forces overcoming that of the spring.

19. A stock lifter device as defined in claim 18 wherein the upright post is of reduced thickness as compared with the cross section of the aligned bores so as to form an annular clearance between the post and the adjacent wall portions of the bores, and wherein the coiled spring lies wholly within the annular clearance in encircling relation to the upright post.

20. A stock lifter device as defined in claim 18 wherein the lower end portion of the stock lifter body is hollowed interiorly and receives the upper end portion of the upright post and wherein the means providing the slidable fit includes a slot in the upper end portion of the upright post which opens out through the upper end and the opposite sides of the post and further includes a pin-like member carried at its opposite ends by the stock lifter body so that the intermediate portion of the pin rides in the slot in crosswise relation to the axis of the aligned bores.

21. A stock lifter device as defined in claim 20 wherein a removable stop element is provided in the hollow interior of the stock lifter body for engaging the open end of the slot to limit upward travel of the pinlike member and hence the stock lifter body, said stop element and said pin-like member being shaped that when in close proximity to one another each blocks the other from egress from the slot.

* * * * *